US007243760B2

(12) United States Patent
Tonoki et al.

(10) Patent No.: US 7,243,760 B2
(45) Date of Patent: Jul. 17, 2007

(54) ELEVATOR DOOR UNIT HAVING MECHANISM TO RELEASE LOCK UNIT MANUALLY IN EMERGENCY

(75) Inventors: Kenzo Tonoki, Tokyo (JP); Yoshiaki Fujita, Fuchu (JP); Shin Murakami, Hachioji (JP); Norihito Togashi, Yokohama (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 567 days.

(21) Appl. No.: 10/775,233

(22) Filed: Feb. 11, 2004

(65) Prior Publication Data

US 2004/0206582 A1 Oct. 21, 2004

(30) Foreign Application Priority Data

Feb. 21, 2003 (JP) ..... 2003-044677

(51) Int. Cl.
*B66B 13/14* (2006.01)

(52) U.S. Cl. ..... 187/316; 187/313

(58) Field of Classification Search ..... 187/313, 187/316, 314, 317; 49/26, 27, 28; 318/280–286, 318/466–470

See application file for complete search history.

(56) References Cited

U.S. PATENT DOCUMENTS

| | | | | |
|---|---|---|---|---|
| 3,878,919 | A * | 4/1975 | Dewhurst | 187/314 |
| 4,357,998 | A * | 11/1982 | Gibson et al. | 187/314 |
| 4,469,200 | A * | 9/1984 | Young et al. | 187/314 |
| 4,529,065 | A * | 7/1985 | Kraft | 187/314 |
| 4,926,975 | A * | 5/1990 | Morris | 187/324 |

FOREIGN PATENT DOCUMENTS

| | | |
|---|---|---|
| CN | 1129668 A | 8/1996 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An elevator door unit includes cage doors, a cage door lock unit, hall doors, and a lock release unit. The cage doors are provided in a cage which moves in a shaft. The cage door lock unit limits and locks the opening width of the cage doors to the width not to permit passing of passengers. The hall doors are provided in a landing hall, and opened interlocking with the cage doors, when the cage stops in a range of facing to the cage doors. The lock release unit releases the cage door lock unit within the opening width by opening the cage doors by manual operation, when the cage stops in a range that the cage doors face to the hall doors.

6 Claims, 4 Drawing Sheets

ELEVATOR DOOR UNIT HAVING MECHANISM TO RELEASE LOCK UNIT MANUALLY IN EMERGENCY

CROSS-REFERENCE TO RELATED APPLICATIONS

This application is based upon and claims the benefit of priority from prior Japanese Patent Application No. 2003-044677, filed Feb. 21, 2003, the entire contents of which are incorporated herein by reference.

BACKGROUND OF THE INVENTION

1. Field of the Invention

The present invention relates to an elevator door unit, and more particularly, to an elevator door unit having a mechanism which manually releases a lock unit of a cage in an emergency such as a power failure.

2. Description of the Related Art

A cage of an elevator may make an emergency stop in sections other than a landing hall of a building when a power failure or other emergency conditions occurs. A passenger in the cage may open the cage door by force. If the cage door is opened forcibly from the inside of the cage, passengers will be exposed to danger. For example, passengers may fall into a shaft. Particularly, an elevator for viewing the outside has an open part where a cage is not surrounded by shaft walls. If a cage makes an emergency stop in this open part and a cage door is opened by force, passengers will be exposed to more danger. Therefore, a cage door is configured not to be opened forcibly from the inside of a cage.

In some elevator, the inside atmospheric pressure of a cage is controlled. A cage is airtight. When an elevator makes an emergency stop because of a power failure or other accidents, a cage door can be manually opened a little to let fresh air into a cage. However, if a cage door should be opened wide, passengers will be exposed to danger of falling, and the opening width of a cage door must be strictly limited.

An elevator is provided with a cage door lock unit. The cage door lock unit locks a cage door by limiting the cage door opening width, so that passengers are not exposed to danger even if a passenger attempts to open the cage door from inside.

The cage door lock unit has a lock pin driven by a solenoid as a driving source. The lock pin is urged by a spring so as to project in one direction. When electricity is applied to the solenoid, the solenoid moves the lock pin against the spring, and unlocks the cage door. In case of emergency such as a power failure or other accidents, the lock pin is pushed out by the spring, and the cage door is held locked.

A gate is provided in a landing hall of each floor of a building. A hall door is provided in each gate. The hall door is provided with a hall door lock unit.

An elevator has an engagement unit. When a cage arrives at a certain floor and a cage door coincides with a hall door, the engagement unit engages the cage door with the hall door. The lock of the hall door lock unit is released by the mechanical operation caused by this engagement. An electric signal is generated by the release of the hall door lock unit, and based on this electric signal, electricity is applied to the solenoid of the cage door lock unit. As a result, the lock pin is driven and the lock of the cage door is released. The cage door is provided with a drive unit. When the drive unit is operated, the cage door is opened together with the hall door. Then, passengers can get on or off the cage.

After passengers get on or off, the cage door and hall door are closed by the drive unit. When the hall door is completely closed, the hall door lock unit operates mechanically to lock the hall door. An electric signal is generated by locking the hall door, and the application of electricity to the solenoid is stopped by this electric signal. The lock pin is urged by the spring to lock the cage door.

If the cage should be stopped at a position where the cage door does not coincide with the hall door in case of emergency, the cage door is prevented by the cage door lock unit from being opened forcibly by a passenger. Even in the case of emergency stop, as long as the cage door coincides with the hall door, the cage door lock unit can be manually operated and unlocked from the landing hall side. The cage door lock unit is unlocked by the manual operation using a push member which pushes mechanically the lock pin. Passengers confined in the cage are rescued by unlocking the cage door lock unit from the landing hall side.

However, even if the cage stops in an emergency at a position where the cage coincides with the hall door, passengers in the cage cannot unlock the cage door lock unit and escape from the cage by their own efforts. The passengers left in the cage must wait for rescue from the outside. Particularly, when a cage stops under emergency conditions such as an earthquake and fire, passengers are confined in the cage and cannot escape from the cage, though the cage is stopping at the landing hall.

BRIEF SUMMARY OF THE INVENTION

It is an object of the present invention to provide an elevator door unit, which allows manual opening of a cage door and a hall door from the inside of the cage when the cage makes an emergency stop in a range of facing to the hall door at a landing hall.

According to an aspect of the prevent invention, there is provided an elevator door unit comprising a cage door, a cage door lock unit, a hall door, and a lock release unit. The cage door is provided in a cage which moves in a shaft. The cage door lock unit limits and locks the opening width of the cage door to the width not to permit a passenger pass through. The hall door is provided at a landing hall, and opened interlocking with the cage door when the cage stops in a range of facing to the cage door. The lock release unit releases the cage door lock unit within the opening width by manually opening the cage door when the cage is in a range that the cage door faces to the hall door.

In this case, a preferable lock release unit is provided with a trigger plate and a push roller. The trigger plate is provided in a cage and interlocked with the door lock unit. The push roller is provided in the hall door, and presses the trigger plate and releases the cage door lock unit while the cage door is being opened within the opening width.

A further preferable form of the trigger plate has a length along the vertical direction of a cage. Operation of the trigger plate is transmitted to the door lock unit by a gear mechanism and a cam mechanism. The trigger plate is also preferable to be elastically urged by a spring in the reverse direction to the cage door lock unit releasing operation. The trigger plate is provided at a position where the cage does not interfere with the push roller of the hall door during moving. It is also effective that the door lock unit is provided with a driving source which electrically unlocks the cage door.

With the elevator door unit configured as described above according to the present invention, when the cage makes an emergency stop in the range of facing to the hall door at a landing hall, a passenger can manually open the cage door and hall door from the inside of the cage, and escape from the cage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
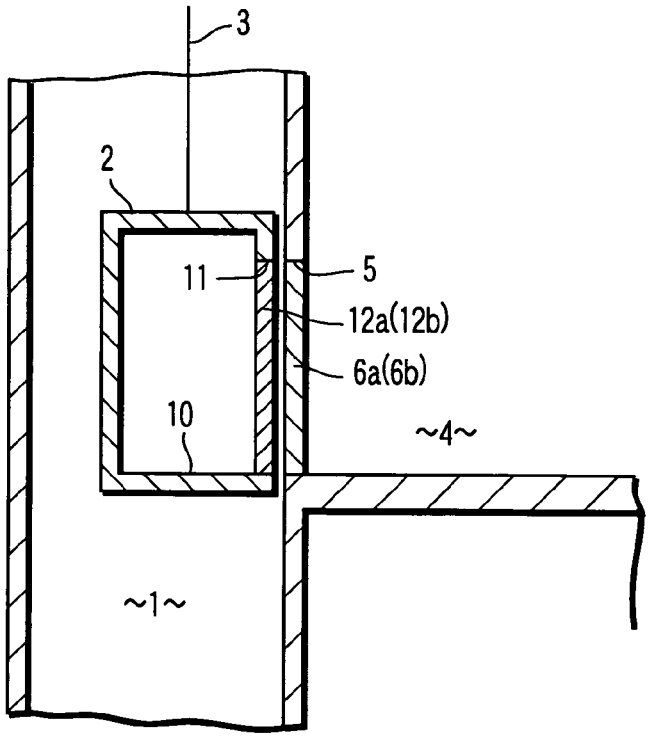
FIG. 1 is a sectional view showing a primary configuration of an elevator according to one embodiment of the present invention.

Description will be given on the elevator door unit according to an embodiment of the present invention with reference to the accompanied drawings. As shown in FIG. 1, an elevator comprises a shaft 1, a cage 2, a main rope 3, a winch, a landing hall 4, a gate 5, and hall doors 6*a* and 6*b*. The shaft 1 is provided vertically in a building. The cage 2 is suspended by the main rope 3 in the shaft 1. The main rope 3 is wound around the winch. By driving the winch, the cage 2 is moved up or down within the shaft 1. The landing hall 4 is provided at each floor of a building. The gate 5 is formed to connect the landing hall 4 to the shaft 1. The hall doors 6*a* and 6B are provided in the gate 5, and constructed as double doors in this embodiment.

Figure 2:
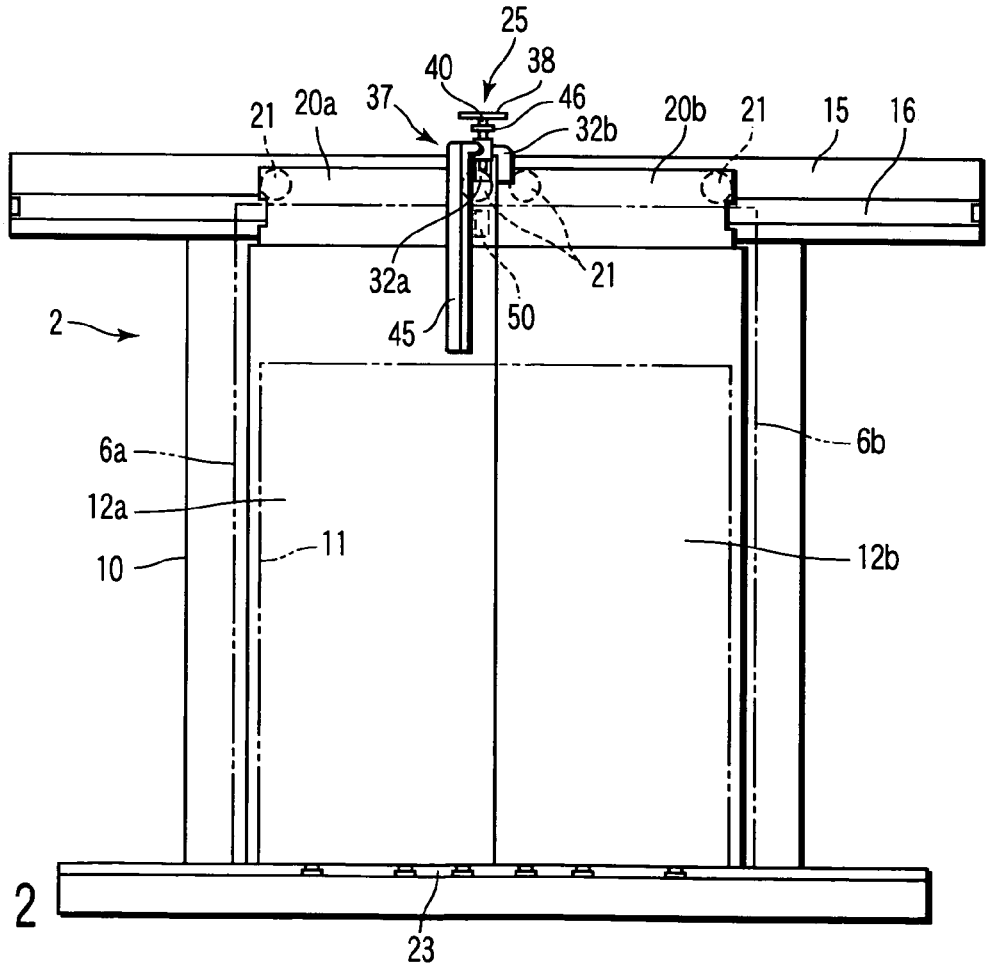
FIG. 2 is a front view of a cage of the elevator shown in FIG. 1 seen from the cage door side.

The cage 2 comprises a cabin 10, an entrance 11, and cage doors 12*a* and 12*b*. The entrance 11 is formed in the side facing to the hall doors 6*a* and 6*b*. The cage doors 12*a* and 12*b* are located just like closing the entrance 11 as shown in FIG. 2, and double doors in this embodiment.

The cage 2 has a member-mounting frame 15 extending horizontally in the outside of the cabin 10 and above the entrance 11, and has a threshold 23 in the outside of the cabin 10 and under the entrance 11. The member-mounting frame 15 is provided with a hanger rail 16 extending horizontally in the side facing to the hall door 6*a*/6*b*. The hanger rail 16 comprises a horizontal part and a vertical part. The horizontal part extends from the member-mounting frame 15 toward the hall door 6*a*/6*b*. The vertical part extends upward from the front end of the horizontal part.

The cage doors 12*a* and 12*b* have hanger 20*a* and 20*b* at the upper end. The hanger 20*a*/20*b* has a pair of hanger rollers 21 mounted rotatable in the cabin 10 side. The cage doors 12*a* and 12*b* are hung on the hanger rail 16, so that the hanger roller 21 rolls contacting on the upper surface of the horizontal part of the hanger rail 16. The lower ends of the cage doors 12*a* and 12*b* are fit in the threshold just like sliding.

The door-driving unit for sliding the cage doors 12*a* and 12*b* are provided in the member-mounting frame 15. The door-driving unit slides the cage doors 12*a*, 12*b* in the direction of approaching or separating each other along the hanger rail 16 and threshold 23. As a result, the entrance 11 of the cabin 10 is opened and closed.

The cage 2 is provided with a cage door lock unit 25 which restricts the opening width of the cage doors 12*a*, 12*b*. The cage door lock unit 25 is provided above the ceiling of the cabin 10 and above the doorstop in the state that the cage doors 12*a* and 12*b* are closed.

Figure 3:
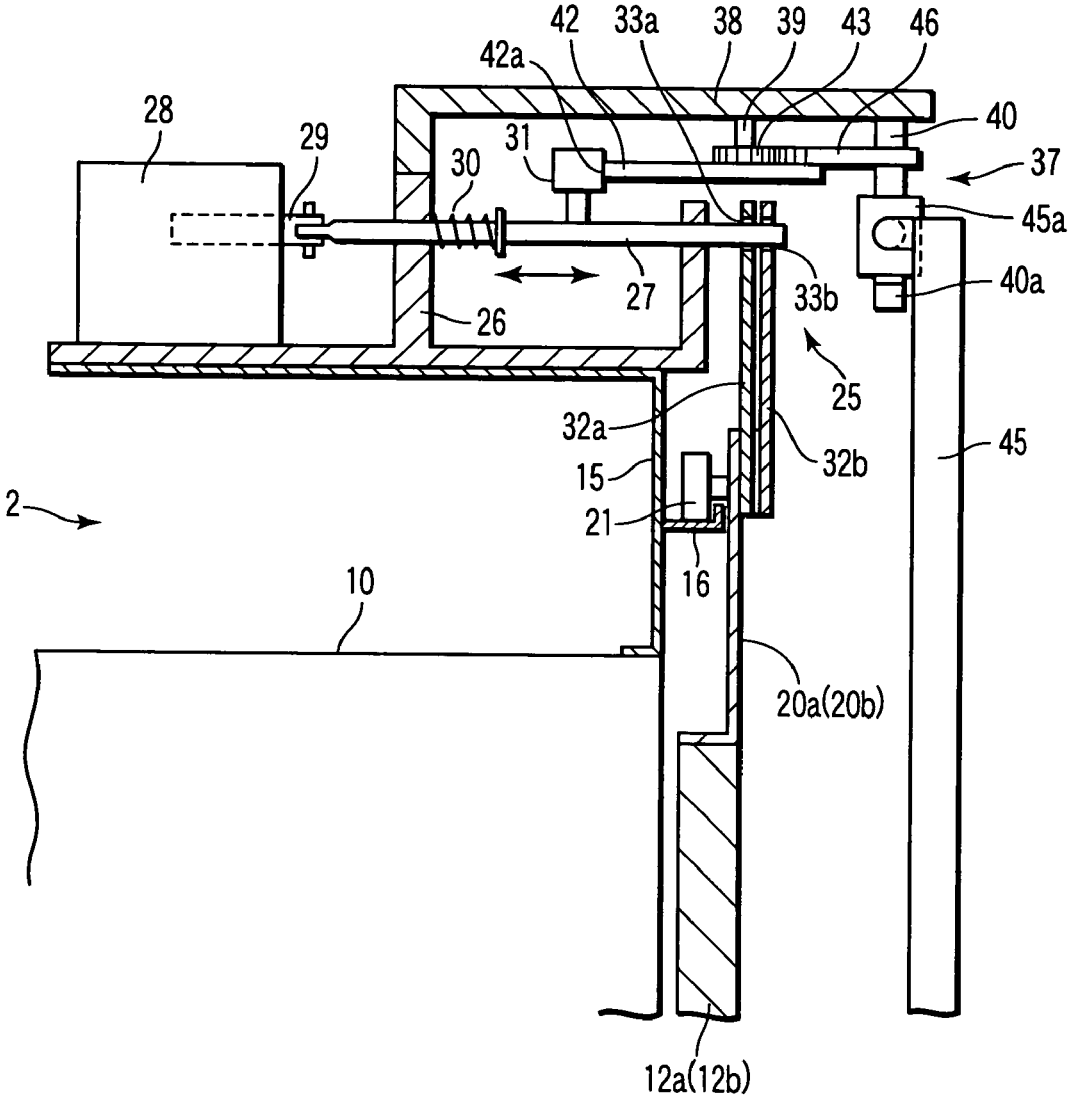
FIG. 3 is a sectional view of a cage door lock unit and a lock release unit of the door unit shown in FIG. 2.

The door lock unit 25 comprises a frame 26, a lock pin 27, a solenoid 28, a plunger 29, a compressed spring 30, and regulation members 32*a* and 32*b*, as shown in FIG. 3. The frame 26 is provided on the member-mounting frame 15 above the cabin 10. The lock pin 27 penetrates the frame 26, sliding across the plane along the cage doors 12*a*, 12*b*. The end of the lock pin 27 projects from the side walls of the cage doors 12*a*, 12*b* of the frame 26 toward the hall doors 6*a*, 6*b* forward of the cabin 10. The lock pin 27 is provided halfway with a lock release roller 31 which rotates on the plan parallel to the ceiling of the cabin 10.

The solenoid 28 and plunger 29 are the driving source which electrically releases the lock of the cage doors 12*a*, 12*b*. The solenoid 28 drives the plunger 29 in the axial direction by the magnetic force generated when electricity is applied. The plunger 29 is connected to the lock pin 27. The compressed spring 30 is inserted onto the lock pin 27 opposite to the plunger 29 with respect to the frame 26, and urges the lock pin 27 elastically in the direction of separating from the solenoid 28.

Figure 4A:
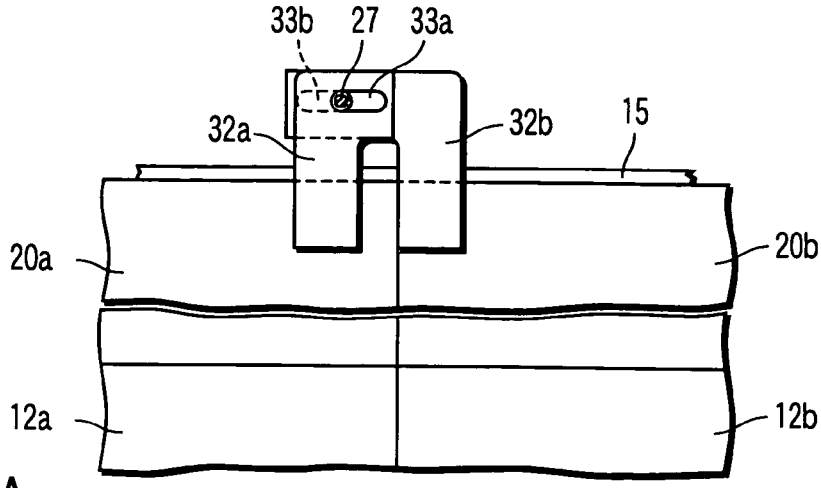
FIG. 4A is a front view showing the state that the lock pin of the cage door lock unit shown in FIG. 3 is engaged with a regulation member, and the cage door is closed.

The regulation members 32*a* and 32*b* are provided in the front sides of the hangers 20*a* and 20*b*, respectively, that is the side facing to the hall doors 6*a* and 6*b*. The regulation members 32*a* and 32*b* have engagement holes 33*a* and 33*b* formed long in the horizontal direction. The regulation members 32*a* and 32*b* are overlapped in the state that the cage doors 12*a* and 12*b* are completely closed, as shown in FIG. 4A. The end of the lock pin 27 is inserted into the engagement holes 33*a* and 33*b* of the cage door lock unit 25 in the locked state.

Figure 4B:
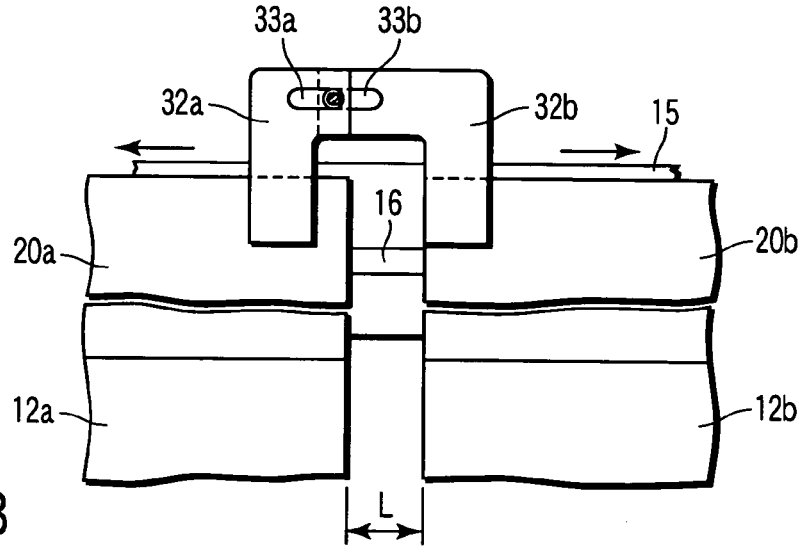
FIG. 4B is a front view showing the state that the lock pin of the cage door lock unit shown in FIG. 3 is engaged with a regulation member and the cage door is opened.

The engagement holes 33*a* and 33*b* have the length to permit manual sliding of the cage doors 12*a* and 12*b* from the closed state shown in FIG. 4A to the slightly opened state shown in FIG. 4B, with the lock pin 27 inserted. The opening width L of the cage doors 12*a* and 12*b* shown in FIG. 4B is limited to the width that a passenger cannot pass through. Actually, the opening width L is preferably about 10 cm. As described above, the opening width L of the cage doors 12*a* and 12*b* is locked by the lock pin 27 of the cage door lock unit 25 in the normal state.

Figure 4C:
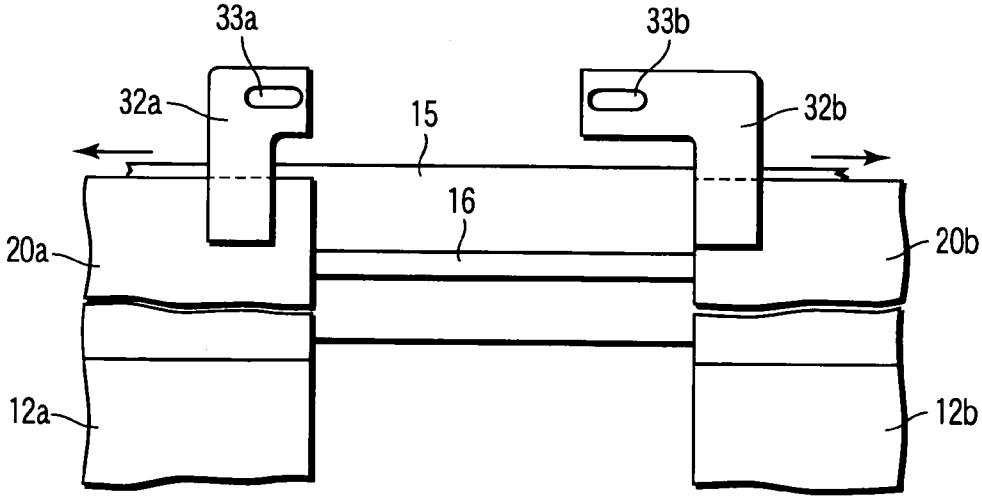
FIG. 4C is a front view showing the state that the lock pin of the cage door lock unit shown in FIG. 3 is disengaged from a regulation member and the cage door is opened.

The solenoid 28 generates a magnetic force when electricity is applied, and attracts the plunger 29 against the elastic force of the compressed spring 30. The lock pin 27 connected to the plunger 29 moves together with the plunger 29 rearward of the cabin 10 in the direction of separating from the hold doors 6*a* and 6*b*. The end of the lock pin 27 is pulled out of the engagement holes 33*a* and 33*b*, and the cage doors 12*a* and 12*b* are unlocked. Therefore, the door-driving unit permits opening of the cage doors 12*a* and 12*b* as shown in FIG. 4C. The hall doors 6*a* and 6*b* are interlocked with the cage doors 12*a* and 12*b* by the engagement unit when the cage 2 stops at the position facing to the cage doors 12*a* and 12*b*.

Figure 5:
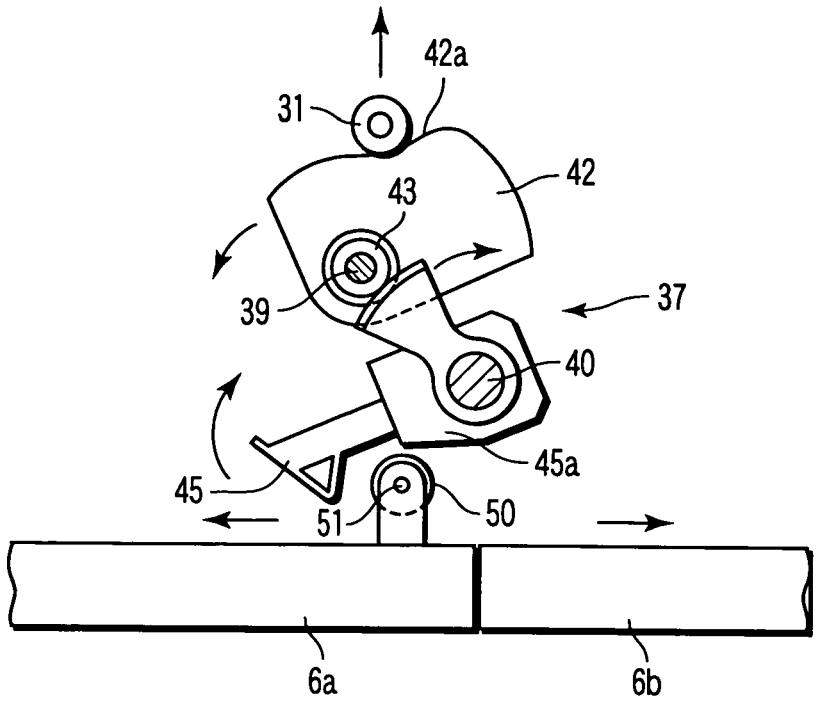
FIG. 5 is a plan view showing the structure of the lock release unit shown in FIG. 3.

An elevator further comprises a lock release unit 37 in this embodiment. The lock release unit 37 comprises a bracket 38, rotary shafts 39 and 40, a cam 42, a gear 43, a trigger plate 45, a gear 46, a lock release roller 31, and a push roller 50, as shown in FIG. 3 and FIG. 5. The lock release unit 37 makes it possible to manually open the cage door lock unit 25 from the inside of the cabin 10 when the cage 2 stops in the range that the cage doors 12*a* and 12*b* face to the hold doors 6*a* and 6*b*.

The bracket 38, whose base is fixed to the frame 26, extends forward to the hall doors 6*a* and 6*b* crossing the cage door lock unit 25 and cage doors 12*a*, 12*b*. The rotary shafts 39 and 40 are provided in the vertical direction from the horizontal part of the bracket 38 to the cage door lock unit 25. The cam 42 and gear 43 are fixed as a single unit, and fit rotatable on the rotary shaft 39. The trigger plate 45 is fit to the rotary shaft 40 through a boss 45*a*. The gear 46 is fit to the rotary shaft 40 so as to rotate as a single unit together with the boss 45*a*. The gears 43 and 46 are engaged each other.

The trigger plate 45 is fixed to the arm projecting from the circumference of the boss 45*a* to the rotation radius direction, and extends downward parallel to the rotary shaft 40 up to the position to overlay on the top of the cage door 12*a*, as shown in FIG. 2. One section of the circumference of the cam 42 has a cam part 42*a* with different rotation radius, as shown in FIG. 5. The cam part 42*a* rolls contacting on the lock release roller 31 fixed to the lock pin 27.

Figure 7:
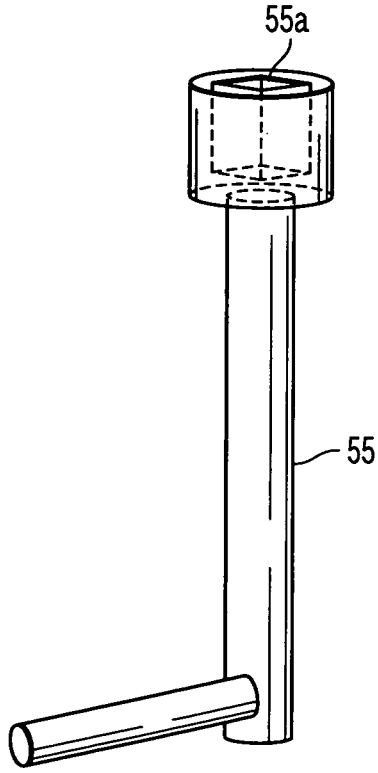
FIG. 7 is a perspective view of a tool for manually operating the lock release unit shown in FIG. 3.

At the lower end of the rotary shaft 40, a fitting part 40*a* having a square cross section is formed to fit with a fitting hole 55*a* of a handle tool 55 shown in FIG. 7. The handle tool 55 is operated from the outside of the cabin 10 to rotate the rotary shaft 40.

Figure 6:
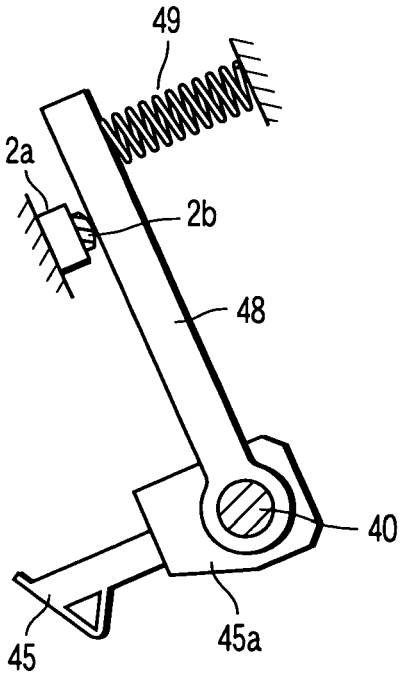
FIG. 6 is a plan view showing the structure to urge elastically a trigger plate of the lock release unit shown in FIG. 3.

An arm 48 extending further in the radial direction is fit to the rotary shaft 40, as shown in FIG. 6. The rotation front end of the arm 48 is urged in the counterclockwise direction in FIG. 6 by a compressed spring 49 whose one end is supported by a part of the top of the cage 2. The side of the arm 48 opposite to the side touched by the compressed spring 49 is elastically touched to an elastic element 2*b* such as rubber provided on the wall part 2 on the top of the cage 2. In the state that the arm 48 touches the elastic element 2*b*, the lock release roller 31 touches that part of the cam part 42*a* which has a small radius of rotation. Since the arm 48 is held between the elastic element 2*b* and compressed spring 49, the trigger plate. 45 does not accidentally swing while the cage 2 is moving.

The push roller 50 is provided on the hall door 6*a*, one of the two hall doors 6*a* and 6*b*, as shown in FIG. 2 and FIG. 5. The push roller 50 is supported by the rear side of the hall door 6*a* facing to the cage doors 12*a* and 12*b*, and rotatable centering around a vertical shaft 51. When the cage 2 is in the range where the cage doors 12*a* and 12*b* face to the hall doors 6*a* and 6*b*, the push roller 50 and trigger plate 45 are located adjacent in the horizontal direction. The trigger plate 45 and push roller 50 are provided at the position not interfering with each other when the cage 2 is moved.

Description will be given on the operation of the door unit based on the above-mentioned configuration.

First, explanation will be given on the normal operation of the door unit.

While the cage 2 is moving, the cage doors 12*a* and 12*b* are closed and locked by the cage door lock unit 25. Each floor is provided with a switch which detects arrival of the cage 2. When the cage 2 stops at the landing hall 4 of an object floor, the switch outputs an arrival signal indicating that the cage 2 is stopped at that floor.

When the arrival signal is outputted and the solenoid 28 is supplied with electricity, the plunger 29 is involved into the solenoid 28. Since the lock pin 27 connected to the plunger 29, the front end of the lock pin 27 is removed from the engagement holes 33*a* and 33*b*, and the cage doors 12*a* and 12*b* are unlocked. While the cage 2 is stopping at the same floor, the cage door lock unit 25 holds the cage doors 12*a* and 12*b* unlocked by continuously applying electricity to the solenoid 28.

When the cage 2 arrives at the landing hall 4, the cage doors 12*a* and 12*b* engage with the hall doors 6*a* and 6*b* provided in that landing hall 4 through the engagement unit. When the cage 2 arrives at the landing hall 4, the hall door lock unit provided separately in the hall doors 6*a* and 6*b* of that landing hall 4 is released. When the cage doors 12*a* and 12*b* are slid by the door-driving unit in the direction of separating from each other, the hall doors 6*a* and 6*b* interlocked with the cage doors 12*a* and 12*b* are also moved, and the entrance 11 of the cabin 10 and the gate 5 of the landing hall 4 are opened.

After passengers get on or off the elevator, the cage doors 12*a* and 12*b* are slid by the door-driving unit, and closed together with the hall doors 6*a* and 6*b*. When the cage doors 12*a* and 12*b* are closed, the supply of electricity to the solenoid 28 is turned off. Since the plunger 29 is removed from the solenoid 28, the lock pin 27 is projected to the front side of the cage 2 by the urging force of the compressed spring 30, and inserted into the engagement holes 33*a* and 33*b* of the overlapped regulation members 32*a* and 32*b*. When the cage doors 12*a* and 12*b* are locked, the cage 2 is permitted to move toward the next object floor.

Next, explanation will be given on the operation of the door unit when the elevator stops in an emergency such as a power failure.

When the cage 2 makes an emergency stop in sections other than the landing hall 4 or in the range that the cage doors 12*a* and 12*b* don't face to the hall doors 6*a* and 6*b*, the lock pin 27 of the cage door lock unit 25 is inserted into the engagement holes 33*a* and 33*b* formed long in the moving direction of the cage doors 12*a* and 12*b*, as shown in FIG. 4A.

The cage doors 12*a* and 12*b*, when opened forcibly by hand from the inside of the cabin 10, open only by the opening width L corresponding to the length of the engagement holes 33*a* and 33*b*, as shown in FIG. 4B. Particularly, in the case of cage 2 having the air tightness of the degree to permit adjustment of the internal pressure, the opening of the cage doors 12*a* and 12*b* helps natural ventilation of the cabin 10 in an emergency, even though the opening width is a little. The opening width L is limited to the width not to permit passengers to pass through.

Since the cage doors 12*a* and 12*b* don't open unnecessarily, passengers are not exposed to danger to fall down from the cage 2. When a rescue team member goes into the shaft 1 and manually operates the fitting part 40*a* by using the handle tool 55, the cage door lock unit 25 is released. After a rescue team member releases the cage door lock unit 25 from the outside of the cabin 10, passengers can escape from the cabin 10.

When the cage 2 makes an emergency stop in the section of the landing hall 4 or in the range that the cage doors 12*a* and 12*b* face to the hall doors 6*a* and 6*b*, the cage doors 12*a*, 12*b* and hall doors 6*a*, 6*b* are engaged with each other through the engagement unit, and the push roller 50 and trigger plate 45 are located adjacent in the sliding direction of the hall doors 6*a* and 6*b*. Even if the cage 2 stops at the position shifted slightly upward or downward from the landing hall 4, the cage doors 12*a*, 12*b* and hall doors 6*a*, 6*b* are engaged with each other through the engagement unit. Since the trigger plate 45 is long enough in the vertical direction, the push roller 50 and trigger plate 45 are also located in the range adjacent to the sliding direction of the hall doors 6*a* and 6*b*.

When the cage doors 12*a* and 12*b* are forcibly opened by hand from the inside of the cabin 10, the hall doors 6*a* and 6*b* are also opened interlocking with the cage doors 12*a* and 12*b*. The push roller 50 fixed to the hall door 6*a* comes in contact with the trigger plate 45 and rotates the trigger plate 45 with the gear 46 in the clockwise direction in FIG. 5 centering around the rotary shaft 40, against the compressed spring 49. The gear 46 rotates the cam 42 counterclockwise through the gear 43 engaged. By the rotation of the cam 42, the lock release roller 31 moves away from the rotary shaft 39.

As a result, the lock pin 27 is moved against the compressed spring 30, and the front end is removed from the engagement holes 33*a* and 33*b* before the cage doors 12*a* and 12*b* are opened to the state shown in FIG. 4B. The cage doors 12*a* and 12*b* are unlocked, and can be opened as shown in FIG. 4C.

Further, the gear ratio between the gears 46 and 43 is set large. By the slight movement of the hall door 6*a*, the lock pin 27 is moved largely. Therefore, the cage doors 12*a* and 12*b* are certainly released. The cam part 42*a* of the cam 42 is shaped not to move the lock release roller 31 after the trigger plate 45 rotates to a certain range. Therefore, it is prevented to break the cam part by pressing excessively the lock release roller 31.

When the cage 2 stops in an emergency in the range that the cage doors 12*a* and 12*b* face to the hall doors 6*a* and 6*b*, this elevator door unit can release the cage door lock unit 25 by opening the cage doors 12*a* and 12*b* slightly by force. Therefore, passenger in the cabin 10 can open the cage doors 12*a*, 12*b* and hall doors 6*a*, 6*b* by hand from the inside of the cabin 10, and escape speedily from the cage 2 to the landing hall 4 without waiting for rescue.

Further, in the elevator door unit configured as described above, the cage doors 12*a*, 12*b* and hall doors 6*a*, 6*b* are interlocked. Therefore, if only the cage 2 stops at the section of the landing hall 4, the cage door lock unit 25 can be released by opening forcibly the hall doors 6*a* and 6*b* from the landing hall 4, and the cage doors 12*a* and 12*b* can be opened by hand.

Further, when the hall doors 6*a* and 6*b* are opened to the position where the push roller 50 is moved beyond the trigger plate 45, the trigger plate 45, cam 42 and lock pin 27 are returned to the initial position by the urging force of the compressed springs 49 and 30. However, as the cage doors 12*a* and 12*b* have already been opened, they are not relocked by the cage door lock unit 25.

Though the explanation has been given based on the double-door type cage door and hall door in this embodiment, the present invention is applicable also to a single-door type.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An elevator door unit, comprising:

a cage door which is provided in a cage which moves in a shaft;

a cage door lock unit which limits and locks an opening width of the cage door to a width to not permit passing of passengers;

a hall door which is provided in a landing hall, and is opened interlocking with the cage door when the cage stops in a range of facing to the cage door; and a lock release unit which releases a lock of the cage door lock unit by opening the cage door within the opening width by manual operation, when the cage is in a range that the cage door faces to the hall door, the lock release unit comprising a trigger plate which is provided in the cage and interlocked with the cage door lock unit, and a push roller which is provided in the hall door and releases the cage door lock unit by pressing the trigger plate while the cage door is opened within the opening width.

2. The elevator door unit according to claim 1, wherein the trigger plate has a length along a vertical direction of the cage.

3. The elevator door unit according to claim 1, wherein the operation of the trigger plate is transmitted to the cage door lock unit by a gear mechanism and a cam mechanism.

4. The elevator door unit according to claim 1, wherein the trigger plate is urged elastically by a spring in a direction opposite to a cage door lock unit releasing direction.

5. The elevator door unit according to claim 1, wherein the trigger plate is provided at a position where the cage does not interfere with the push roller during movement.

6. The elevator door unit according to claim 1, wherein the cage door lock unit has a driving source which electrically releases the lock of the cage door.

* * * * *